US006490799B2

(12) United States Patent
Eich et al.

(10) Patent No.: US 6,490,799 B2
(45) Date of Patent: Dec. 10, 2002

(54) LONG-HAIR CUTTER UNIT

(75) Inventors: Stefan Eich, Steinbach (DE); Reinhold Eichhorn, Idstein (DE); Michael Harms, Oberursel (DE); Sebastian Hottenrott, Idstein (DE); Peter Junk, Schmitten (DE); Rudolf Majthan, Eschborn (DE); Michael Odemer, Niddatal (DE); Jens Störkel, Frankfurt (DE); Michael Vankov, Schmitten (DE); Jürgen Wolf, Kriftel (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 10/099,632

(22) Filed: Mar. 15, 2002

(65) Prior Publication Data

US 2002/0092177 A1 Jul. 18, 2002

Related U.S. Application Data

(63) Continuation of application No. PCT/EP00/07349, filed on Jul. 29, 2000.

(51) Int. Cl.[7] ..... B26B 19/06
(52) U.S. Cl. ..... 30/223; 30/221; 30/346.51
(58) Field of Search ..... 30/208, 214, 223, 30/224, 225, 43.92, 346.31, 34.1

(56) References Cited

U.S. PATENT DOCUMENTS

| | | | | |
|---|---|---|---|---|
| 4,144,640 | A | 3/1979 | Bucholz | 30/221 |
| 4,765,060 | A | 8/1988 | Veselaski et al. | 30/208 |

FOREIGN PATENT DOCUMENTS

| | | |
|---|---|---|
| EP | 0 652 085 A1 | 11/1994 |
| GB | 2 094 698 A | 2/1982 |
| WO | WO 00/38889 | 7/2000 |

*Primary Examiner*—Douglas D. Watts
(74) *Attorney, Agent, or Firm*—Fish & Richardson P.C.

(57) ABSTRACT

The invention is directed to a long-hair cutter unit (LHS) for a dry shaving apparatus (TR), with a dimensionally stable cutting comb (11) having one cutting teeth row (17) and at least one bearing surface (110) for at least one engagement surface (120) of an arcuately curved, hardened cutting blade (12) having one cutting teeth row (18) and held in engagement with the cutting comb (11) by a pressure of at least one spring element (19, wherein the curvature of the hardened cutting blade (12) is partially configured by means of a forming process such as to ensure conformance and slidable contact of the engagement surface (120) of the cutting blade (12) with the bearing surface (110) of the cutting comb (11) by means of the partial curvatures as well as their restoring forces under the action of the pressure of the spring element (19).

19 Claims, 6 Drawing Sheets

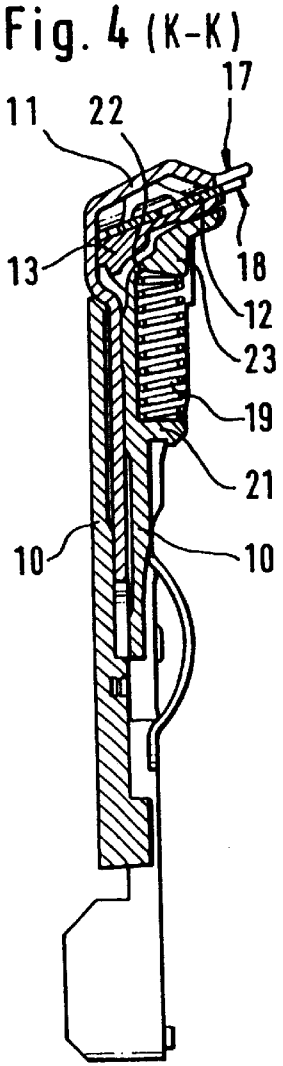
Fig. 4 (K-K)
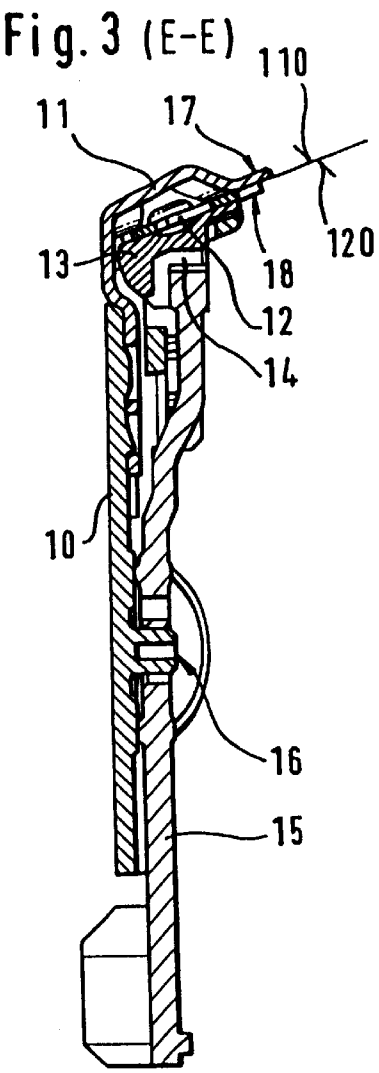
Fig. 3 (E-E)
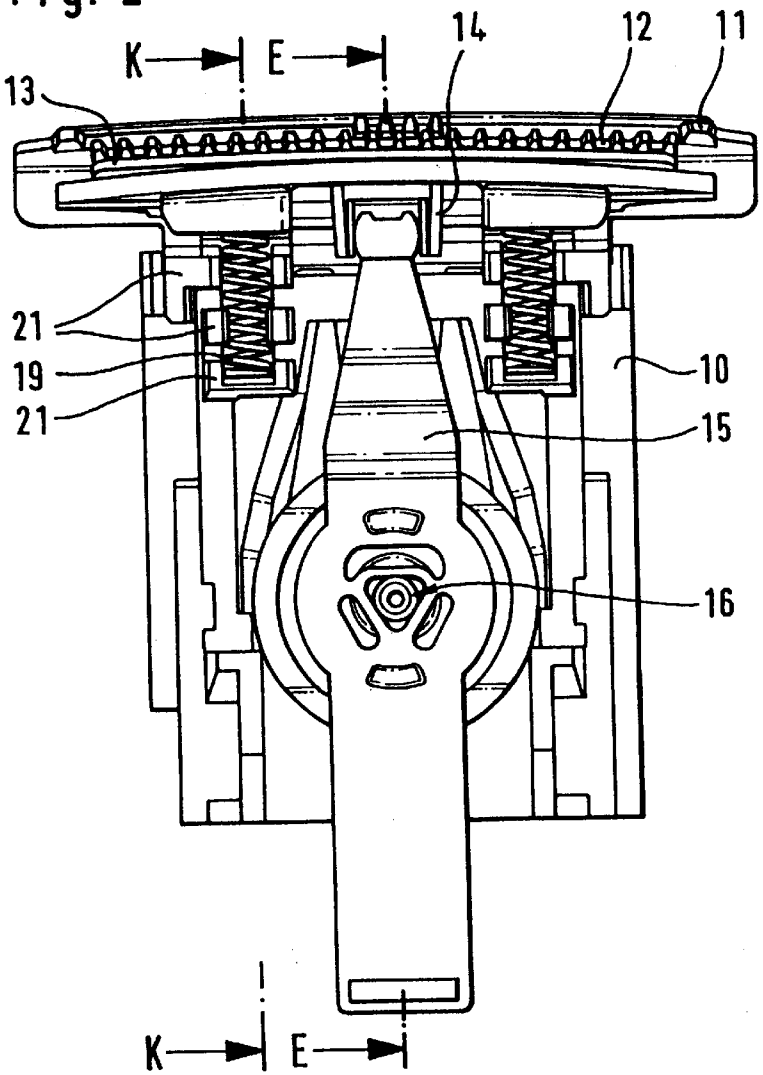
Fig. 2

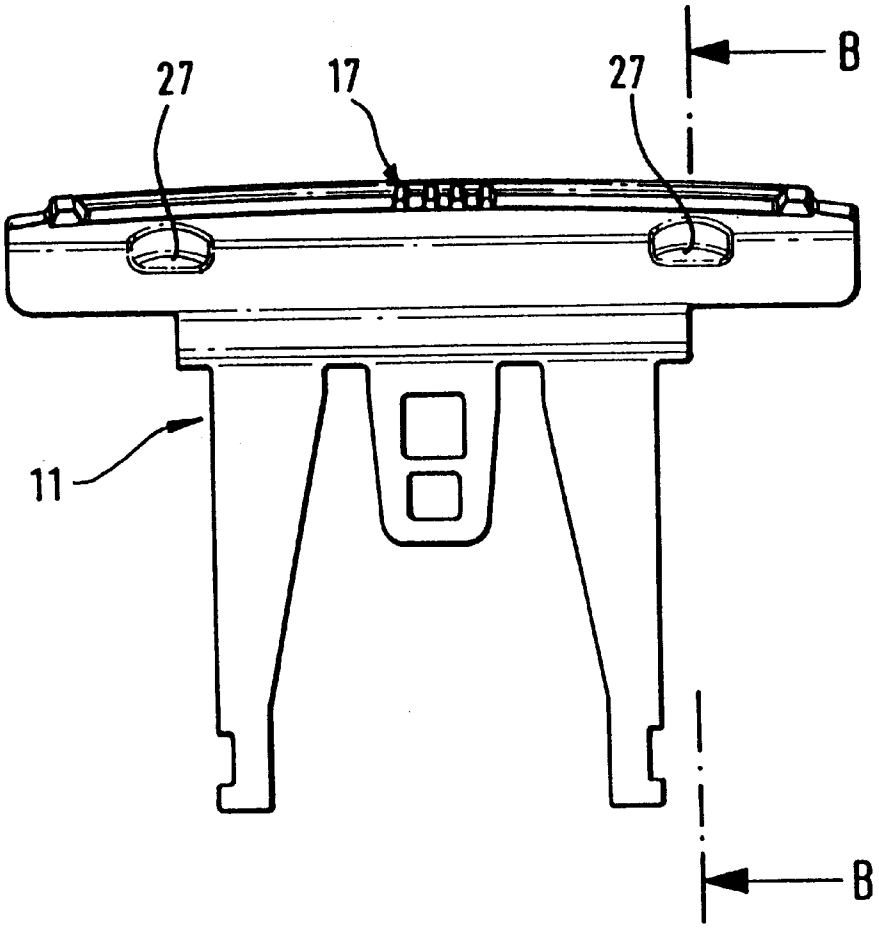
Fig. 5
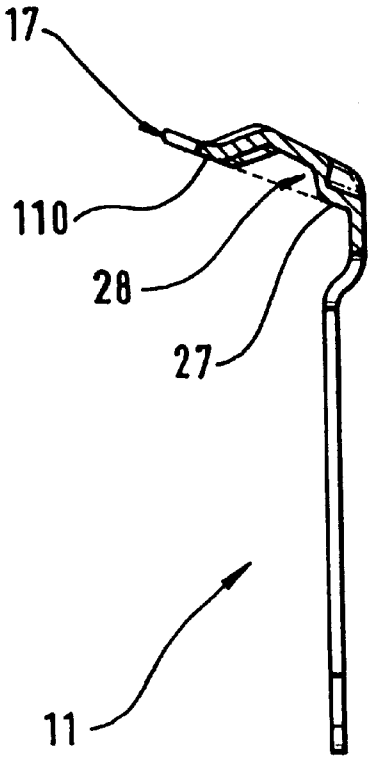
Fig. 6 (B-B)

LONG-HAIR CUTTER UNIT

This is a continuation of Application No. PCT/EP00/07349, filed Jul. 29, 2000.

This invention relates to a long-hair cutter of the type identified in the prior-art portion of claim 1.

A long-hair cutter unit of the type initially referred to is known from DE 38 19 055 C2. To achieve face-level engagement between the sharp cutting edges of the cutting comb and cutting blade a hardened cutting blade is face-ground on one or both sides, taking care to maintain a uniform thickness of the cutting blade. Grinding off the rolling skin of the cutting blade causes the material to distort by bending upon removal of the cutting blade from the grinding device. This arbitrary bending of the cutting blade rules out its optimal cooperation with the bearing surface of a dimensionally stable cutting comb. In order to adapt the form of the bent cutting blade so that it conforms with the plane bearing surface of the cutting comb provision is made according to this printed specification for a pressure lip that is made of both an elastically and plastically deformable material and acts on the cutting blade.

From EP 0 652 085 A1 it is known to grind the bearing surfaces of the cutting teeth of one of the two cutters—the cutting comb or the cutting blade—of a long-hair cutter to a slightly concave shape only in parallel direction to the teeth, while the other of the two cutters is ground slightly concave only in parallel direction to the row of cutting teeth in the area of the bearing surfaces of the cutting teeth between the two outermost cutting teeth. This slightly hollow grinding is produced by a rotatably drivable grinding wheel with a curved or arched peripheral surface whose radius of curvature has a value of twelve meters. When the crosswise hollow ground cutters are assembled the result is a four-point support that rules out perfect contact between the cutting teeth when the long-hair cutter is put into operation. Furthermore, the hollow grinding of the two cutters causes more or less of the rolling skin to be abraded from the two cutters, resulting accordingly in an undesirable additional curvature that hinders an optimal cooperation of the crosswise hollow ground cutting teeth.

It is an object of the present invention to provide a long-hair cutter of the type initially referred to, in which optimal contact between the cutting comb and the cutting blade is guaranteed in the assembled state.

According to the invention this object is accomplished with a long-hair cutter of the type initially referred to by the features specified in claim 1.

A further solution for accomplishing this object is characterized by the features specified in claim 2.

An essential advantage of the solutions of the invention is that it is possible to individually adapt the engagement surface of the cutting blade, which is movable in a reciprocating fashion, in relation to the bearing surface of a cutting comb. Two different production methods are available for producing the curvature of a cutting blade whereby, without any stock being removed from the cutting blade, the cutting blade is forced to adopt the necessary curvature or curvatures, guaranteeing that the cutting surface of the cutting blade adapts to and makes sliding contact with the bearing surface of the cutting comb, while at the same time a necessary restoring force or elasticity of the bent cutting blade is ensured.

A preferred embodiment of the invention is characterized in that the curvature of the engagement surface of the cutting blade is defined by a sequence of arch elements of similar and dissimilar curvature, with the junctions connecting the arch elements being provided as cutting blade bending points for adapting the engagement surface of the cutting blade to conform with the bearing surface of the cutting comb under the action of the pressure of the spring element. With this embodiment an effective adaptation of the engagement surface on the cutting blade to the form of the bearing surface of the cutting comb is already guaranteed when the longitudinal dimension of the cutting blade is divided into at least three arch elements. With this embodiment there should preferably be at least two curvatures with coincidental radii and one curvature with a deviating radius. Adapting the engagement surface of the cutting blade to conform with the bearing surface of the cutting comb is promoted in that the curvature with the deviating radius is provided between two curvatures with identical radii.

According to a further advantageous embodiment of the invention provision is made for the curvature of the engagement surface of the cutting blade to be defined by a sequence of arch elements of identical curvature, with the junctions connecting the arch elements being provided as cutting blade bending points for adapting the engagement surface of the cutting blade to conform with the bearing surface of the cutting comb under the action of the pressure of the spring element. This embodiment is suitable particularly for cutting blades whose engagement surface cooperates with a plane or slightly concave or slightly convex bearing surface of a cutting comb. In addition, this embodiment is particularly well suited for ensuring contact with the bearing surfaces of cutting combs that have production-induced deviations in the surface structure of the bearing surface.

According to an embodiment of the invention provision is made for the longitudinal dimension of the cutting blade to be divided into arch elements by at least two bending points.

According to a preferred embodiment of the invention provision is made for at least two rows of bending points to be arranged parallel to a longitudinal dimension of the cutting blade.

According to a further embodiment of the invention provision is made for the wide dimension of the cutting blade to be divided into arch elements by at least one bending point. This approach promotes the pressing of the engagement surface of the cutting blade against the bearing surface of the cutting comb under the action of pressure from at least one spring element.

In a further embodiment of the invention provision is made for the bending point to be formed by a continuous gradual adaptation of the arcuate curvature of an arch element to conform with the arcuate curvature of the adjoining arch element. This adaptation prevents a kink forming in the curved path of the cutting blade.

A preferred embodiment of the invention is characterized in that provision is made for at least two spring elements such that the relative distance of one spring element to one end of the cutting blade is equal to the relative distance of the other spring element to the other end. In a further aspect of this embodiment provision is made for the relative distance of the spring elements to be essentially equal to the relative distance of one spring element to one end of the cutting blade. This approach promotes the conforming of the curvature of the cutting blade with the cutting comb while maintaining its restoring force or elasticity, and it effects a balanced engagement and sliding action of the cutting blade relative to the cutting comb.

An advantageous embodiment of the invention is characterized in that the direction of the pressure exertable by a spring element is directed essentially onto one bending point. This promotes the changing of form of the respective curvatures of the cutting blade adjoining the bending point. An optimal engagement and cutting action of cutting comb and cutting blade is guaranteed in that the hardened cutting blade with bending points has an elasticity or restoring force that counteracts a permanent deformation of the curvature of the cutting blade under the action of pressure from the spring element.

According to a further embodiment of the invention provision is made for the arcuate form and the bending points of the arch elements of the cutting blade to be manufacturable by embossing using an embossing die and an embossing pad. A further manufacturing method for the cutting blade is characterized in that the arcuate form and the bending points of the arch elements of the cutting blade are manufacturable by varying the compressive stress of the rolling skin of the hardened blade. The advantage of this method is that the engagement surface of the cutting blade is variable partially and individually such that both similar and dissimilar compressive stresses are partially produced in the rolling skin of the hardened cutting blade, which stresses result in similar and dissimilar curvatures of the cutting blade. Using this method enables optimal control with respect to the conformance of the engagement surface of the cutting blade to the bearing surface of the cutting comb. Preferably, the compressive stress of the rolling skin is produced by means of a laser beam of both constant pulse energy and variable pulse energy in order to achieve the compressive stress and hence the curvature required at the respective place on the engagement surface of the cutting blade.

Some preferred embodiments of the present invention are represented in the subsequent description and the accompanying drawings. In the drawings, FIG. 1 a view of the front side of a shaving apparatus with a long-hair cutter unit;

FIG. 2 is a view of the front side of a long-hair cutter unit having its components arranged on a carrier plate;

FIG. 3 is a longitudinal sectional view of the long-hair cutter unit, taken along the line E—E of FIG. 2;

FIG. 4 is a longitudinal sectional view of the long-hair cutter unit, taken along the line K—K of FIG. 2;

FIG. 5 is a view of the cutting blade having sliding surfaces integrally formed thereon;

FIG. 6 is a vertical sectional view of the cutting comb, taken along the line B—B of FIG. 5;

Figure 1:
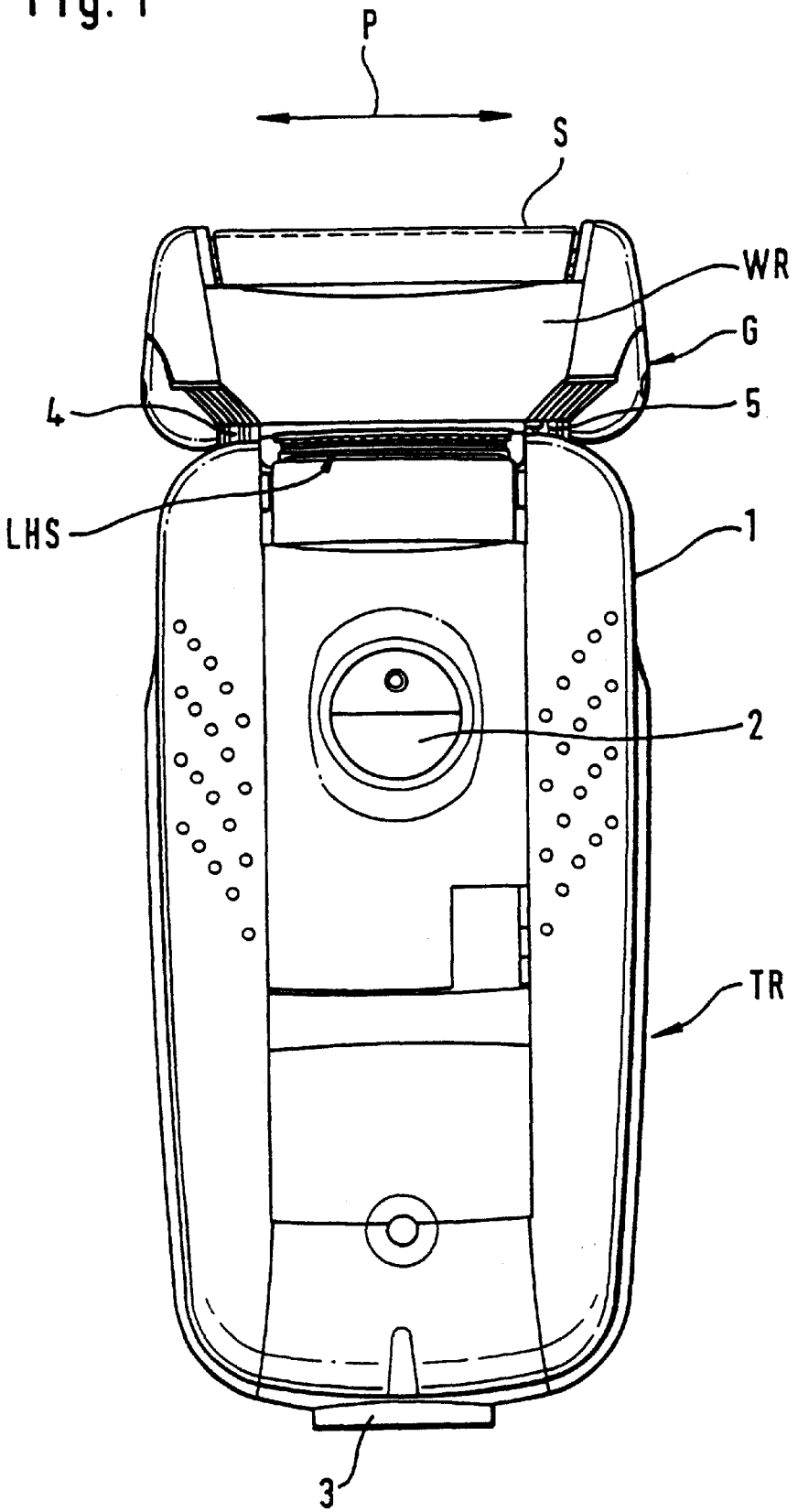

FIG. 1 shows a dry shaving apparatus TR with a housing 1 in the front panel of which there is an actuating switch 2 and an adjustably mounted long-hair cutter unit LHS. In the base wall of the housing 1 is an appliance socket 3 for connecting a power cord. Provided on the housing 1 is a shaving head, in whose housing part G an exchangeable frame WR with at least one cutter element S is detachably fastened. The housing part G of the shaving head is coupled to two carrier elements 4 and 5. The carrier elements 4 and 5 are mounted together with the housing part G to be moveable in a reciprocating fashion in the directions of the arrows P inside the housing 1.

FIG. 2 shows the front side of a long-hair cutter unit LHS whose components are arranged on a carrier plate 10. Fastened to the carrier plate 10 is an essentially L-shaped, dimensionally stable cutting comb 11. Cooperating with the cutting comb 11 is a cutting blade 12 which is arranged on a support body 13 with an integrally formed coupling element 14. A drive element 15, which is mounted for oscillation by means of a pivot bearing 16 provided on the carrier plate 10 for example, engages in the coupling element 14. In the representation of the embodiment of FIG. 2, a section taken along the line K—K and a further section taken along the line E—E are drawn by respective dot-and-dash lines the details of which will become apparent from FIGS. 3 and 4.

FIG. 3 shows the longitudinal section taken along the line E—E of FIG. 2, which extends through the center of the long-hair cutter unit LHS. The essentially U-shaped cutting comb 11 is fastened to the inner side of the carrier plate 10. The drive element 15, which is pivotally mounted by means of the pivot bearing 16, is engaged by its end close to the cutting comb 11 with the coupling element 14 provided on the support body 13. The cutting blade 12 is fastened to the support body 13. The engagement surface 120 of the cutting blade 12 has its cutting teeth row 18 in engagement with the cutting teeth row 17 of the cutting comb 11 on the one side, and on the other side in engagement with the sliding surfaces 27 which, separated by a recess 28, are provided opposite the cutting teeth row 17 on the cutting comb 11 and, together with the cutting teeth row 17, form the bearing surface 110 of the cutting comb 11.

FIG. 4 shows a vertical section K—K through the long-hair cutter unit LHS, from which in particular the transfer of pressure from the spring element 19 to the cutting blade 12—see FIG. 2—is evident. The spring element 19 is guided and held by holding elements 21 provided on the carrier plate 10. A pressure element 23 integrally formed on the carrier plate 10 by means of a film hinge transfers the pressure from the spring element 19 to the support body 13. The support body 13, which extends parallel to the longitudinal dimension of the cutting blade 12, transfers the pressure from the spring element 19 to the cutting blade 12 and, by overcoming the restoring forces of the partial curvatures of the cutting blade 12, results in the engagement surface 120 of the cutting blade 12 conforming itself to and making sliding contact with the bearing surface 110 of the cutting comb 11.

FIG. 5 shows a view of the side of the cutting comb 11 which receives the cutting blade 12. On the inner side of the cutting comb 11 underneath the cutting teeth row 17—of which only a few cutting teeth are illustrated—two sliding surfaces 27 for contact with the engagement surface of a cutting blade 12 are provided on the rear wall extending in vertical direction. Details of the section B—B extending through the cutting comb 11 and entered as a dot-and-dash line are presented in FIG. 6 and will be explained in more detail in the following.

FIG. 6 shows a section through the essentially L-shaped cutting comb 11 having an integrally formed sliding surface 27 which is separated by a recess 28 from the sliding surface formed by the cutting teeth row 17. The sliding surface of the cutting teeth row 17 and the sliding surface 27 combine to form the bearing surface 110 of the cutting comb 11, along which the cutting blade 12 is slidable in a reciprocating fashion when the long-hair cutter unit LHS is put into operation.

Figure 7:
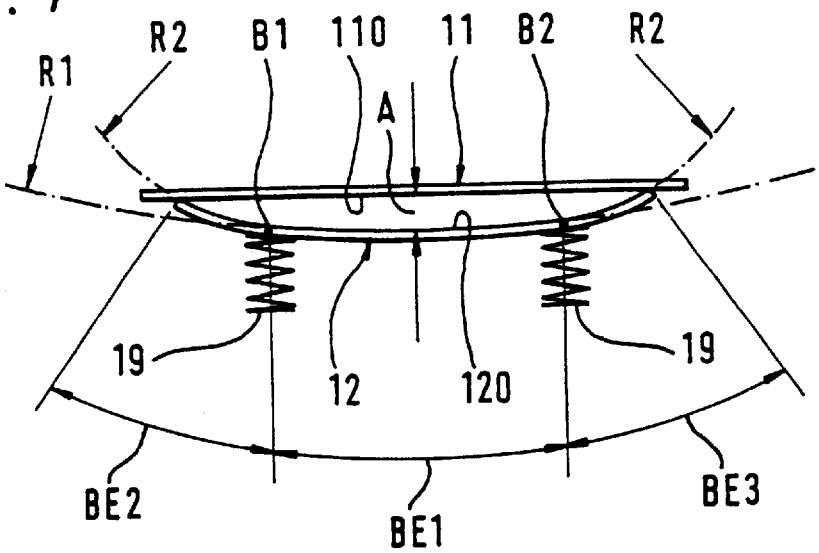
FIG. 7 is a schematic view of cutting comb and cutting blade with arch elements of similar and dissimilar curvature defined by bending points.
Figure 8:
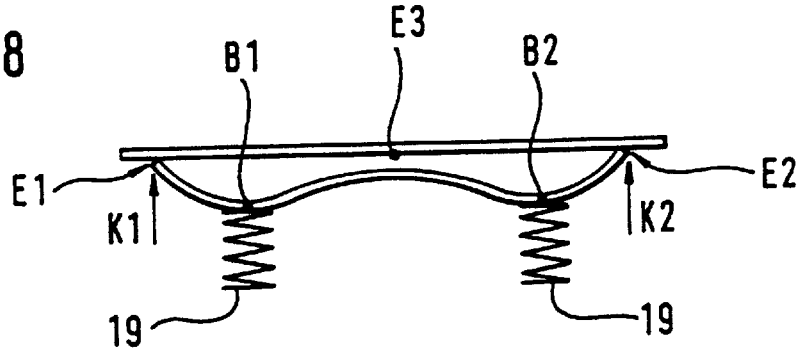
FIG. 8 is a view of a dimensionally stable cutting comb and of a cutting blade having partial curvatures.
Figure 9:
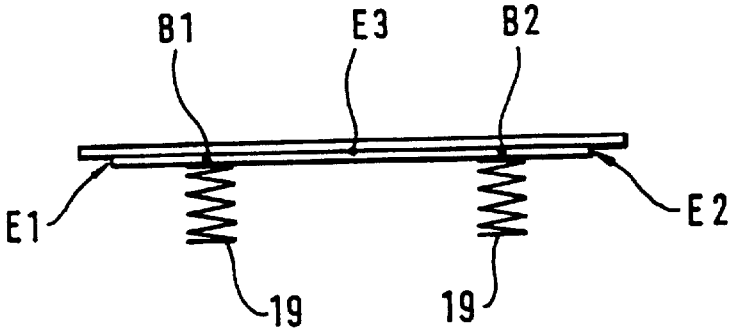
FIG. 9 is a view of a dimensionally stable cutting comb shown in engagement with the cutting blade under the action of two spring elements.

FIG. 7 shows a schematic representation of a dimensionally stable cutting comb 11 with a plane bearing surface 110 for contact with the engagement surface 120 of a cutting blade 12 having partial curvatures. In the embodiment of FIGS. 7, 8 and 9 the partial curvatures of the cutting blade 12 are defined by the bending points B1 and B2 and by the respective end contact of the cutting blade 12 with the bearing surface 110 of the cutting comb 11. The middle curvature bounded by the bending points B1 and B2 is identified as arch element BE1, and the adjoining lateral curvatures are identified as arch elements BE2 and BE3. The radius of curvature R2 of the arch element BE2 is of the same magnitude as the radius of curvature R2 of the arch element BE3. Notwithstanding this arrangement, the radius of curvature R1 of the arch element BE1 is larger than the radius of curvature R2. The bending points B1 and B2 can be produced, for example, by embossing using an embossing die and an embossing pad, or by varying the compressive and tensile stresses of the rolling skin of the hardened cutting blade 12 using a laser beam. The curvature of the cutting blade 12 in the area of the distance A is typically of an order of magnitude of 0.03 to 0.3 mm. The distance A formed by the curvature preferably lies in a range from 0.05 mm to 0.15 mm.

In the embodiment of FIG. 7 two spring elements 19, for example,—in accordance with the representation shown in FIG. 2—preferably act on the bending points B1 and B2, moving the curved cutting blade 12 into contact with the cutting comb 11. The process of deforming the curved cutting blade 12 into elongated contact with the cutting comb 11 will be explained in more detail with reference to FIG. 8 on the basis of FIG. 7. In the embodiment of FIG. 7 the cutting blade 12 initially rests without force against the points E1 and E2 on the cutting comb 11. After pressure is applied by the spring elements 19 to the cutting blade 12, preferably to the bending points B1 and B2 of the cutting blade 12, the reaction forces K1 and K2 at the supports E1 and E2 increase. Since the radius R1 of the arch element BE1, and hence its restoring force, is significantly smaller than that of the arch elements BE2 and BE3, the arch element BE1 is made to bend in the direction of the bearing surface 110 of the cutting comb 11 until contact is made with the point E3. Thereupon the predetermined and prevailing pressure of the spring elements 19 causes the bending points B1 and B2 to move in the direction of the cutting comb 11 until full contact is established by both the bending points B1 and B2 and the arcuate surfaces of the arch elements BE1 to BE3 of the engagement surface 120 of the cutting blade 12. The deflection of the arch element BE1 mid-way between the two bending points B1 and B2 effects, via the force of pressure at the point E3, a uniform distribution of the pressure exerted by the pressure elements 19 on the cutting blade 12, thus guaranteeing that the engagement surface 120 of the cutting blade 12 displays close conformance to and sliding contact with the bearing surface 110 of the cutting comb 11.

Figure 10:
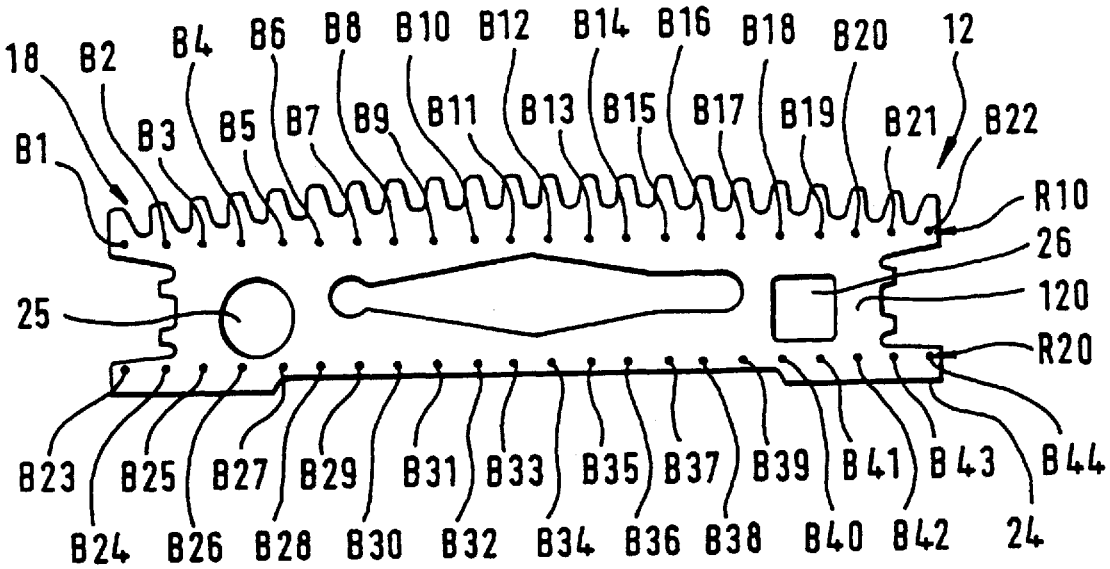
FIG. 10 is a view of the engagement surface of a cutting blade having one row of cutting teeth and two parallel rows of bending points.

FIG. 10 shows a view of the engagement surface 120 of a cutting blade 12 with a succession of arch elements BE1 to BE42 bounded by bending points B1 to B44. The bending points B1 to B22 are provided in a straight line, for example, which extends adjacent a slightly arcuate cutting teeth row 18 of the cutting blade 12. These bending points B1 to B44 are produced by exposing the cutting blade 12 to laser beams, for example. In the zone of interaction between the laser beam and the material, the material of the hardened cutting blade 12 is first heated in part and then cools off. The stresses created in the material by this treatment effect corresponding curvatures in the cutting blade 12, the size of which is controllable by a corresponding heat balance at the point of interaction. The laser treatment causes the compressive stress in the rolling skin of the hardened cutting blade 12 to be reduced and the longitudinal dimension of the cutting blade 12 to be divided into one or several defined arch elements. The result is therefore an individually designable curvature of the cutting blade 12 depending on the arrangement and number of laser points and/or lines in both longitudinal and transverse direction of the cutting blade 12.

In the embodiment of FIG. 10 provision is made for two rows R10 and R20 of bending points B1 to B22, one row being adjacent the cutting teeth row 18 and the other row a relatively short distance from the outer edge of the cutting blade 12 extending in longitudinal direction. The bending points B1 to B22 formed by the exposure points of the laser beam are produced by a pulsed solid-state laser with a power rating of between 50 and 100 watts and a pulse energy of 1 Nm, approximately. The bending points B23 to B44 of the row R20 are produced in the same way. The rows R10 and R20 effect a change of form such that, looking in longitudinal direction, the ends of the cutting blade 12 are raised into a curvature with a central distance A relative to a secant S* connecting the ends of the cutting blade 12. Looking in transverse direction the tips of the teeth in the cutting teeth row 18 as well as the opposing side of the cutting blade 12 are raised likewise by a distance B. Both changes of form result in the engagement surface 120 of the cutting blade 12 being optimally adapted to and making sliding contact with the bearing surface 110 of the cutting comb 11.

Provision is made in the cutting blade 12 for two openings 25 and 26 for fastening the cutting blade 12 to the support body 13—see FIG. 3.

Figure 11:
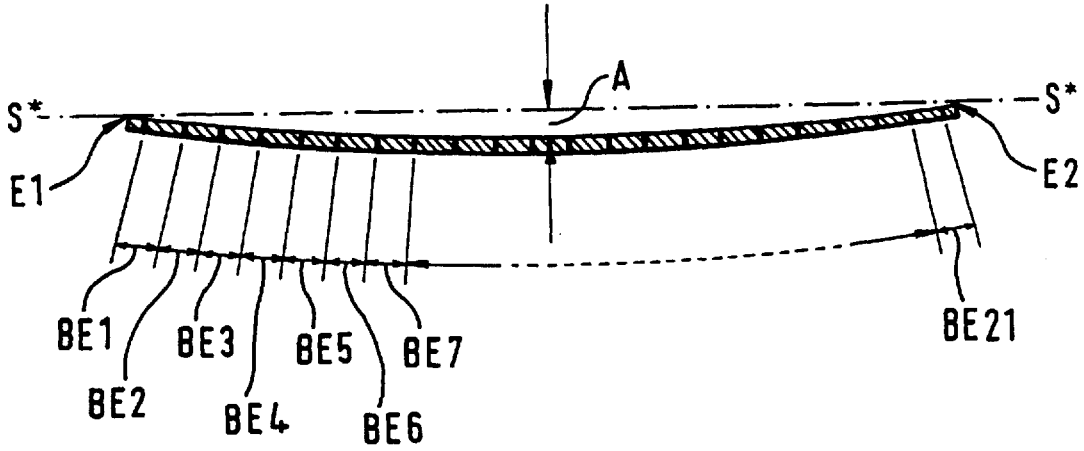
FIG. 11 is a view of a cutting blade having a curvature produced by a sequence of bending points.

FIG. 11 shows a section through the cutting blade 12 of FIG. 10, for example, in the area of the bending point row R10. The arch elements BE1 to BE21 provided here are bounded by bending points B1 to B22 respectively. The curvature of the engagement surface 120 of the cutting blade 12 in the area of the cutting teeth row 18 is defined by a succession of arch elements BE1 to BE21 of identical curvature with a central distance A relative to a secant S* connecting the ends of the cutting blade 12. The junctions connecting the arch elements BE1 to BE21 are provided as bending points B1 to B22, with the curvature of the arch elements BE1 to B22 having been produced by exposure of the respective bending point B1 to B22 to a laser beam with constant pulse energy.

Figure 12:
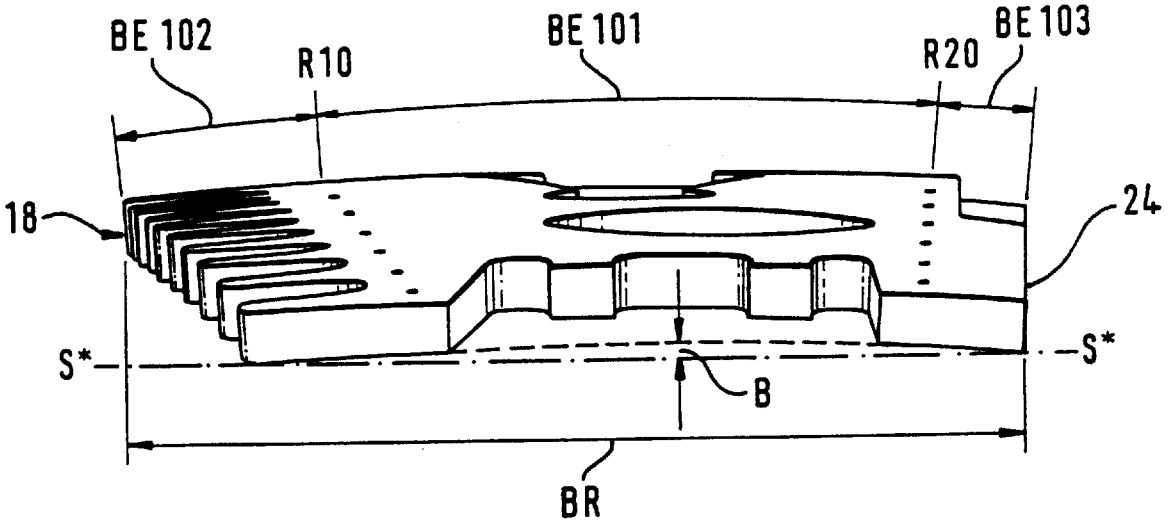
FIG. 12 is a perspective view of a cutting blade showing the broad side of the cutting blade.

FIG. 12 shows a perspective representation of the cutting blade 12 with a cutting teeth row 18 according to FIGS. 10 and 11, with a view of its wide dimension BR. The wide dimension BR of the cutting blade 12 is divided into three arch elements BE101, BE102 and BE103 by means of two rows R10 and R20 of bending points B1 to B44 extending along the longitudinal dimension L of the cutting blade 12. Given a wide dimension BR of approximately 6.8 mm, the relative distance of the row R10 to the outermost ends amounts to approximately 2.8 mm±1 mm, the relative distance of the row R10 to the row R20 amounts to approximately 2.8 mm±1 mm, and the relative distance of the row R20 to the outer edge 24 amounts to approximately 1.2 mm±1 mm. The central distance B relative to a secant S* resulting from arranging the arch elements BE100, BE101 and BE102 side by side amounts to 4 μm in the embodiment shown. The curvature of the cutting blade 12 in the area of the distance B is typically of an order of magnitude of 0 to 15 μm and preferably lies in a range of 3–5 μm.

Figure 13:
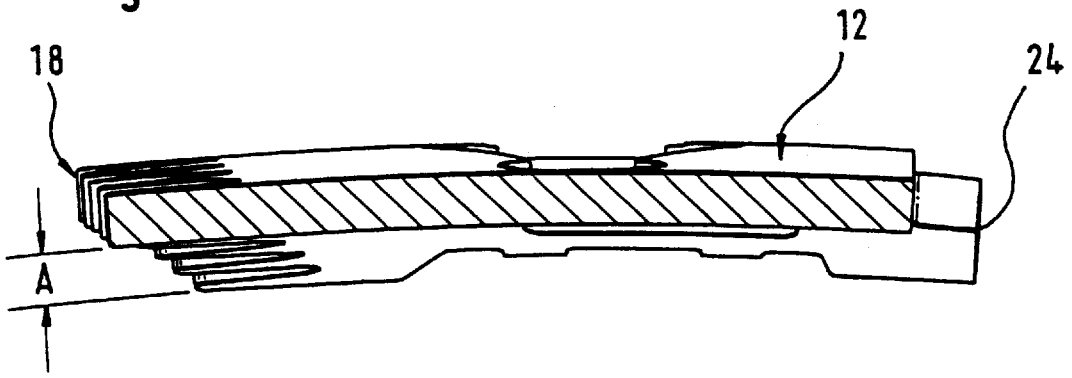
FIG. 13 is a perspective view of the cutting blade of FIG. 12 with a cross section through the center of the cutting blade.

FIG. 13 shows a perspective representation of the cutting blade 12 of FIG. 12, with a section through the center of the cutting blade 12. The maximal distance A relative to a secant S* formed by the curvature of the arch elements BE—see FIG. 11—amounts to approximately 90 μm in the embodiment shown.

Unlike the arrangement in one and/or several straight rows R10 and R20, the bending points B1 to B44 in the respective case of application can be provided at other points of the engagement surface 120 of a cutting blade 12, depending on requirements, to produce a curvature capable of deforming under indirect or direct action of the pressure of a spring element 19. Where required, such deviations from an arrangement in a straight row R10, R20 must first be determined by taking comparative measurements on the cutting comb 11 and cutting blade 12 and then be accordingly implemented at production level.

What is claimed is:

1. A long-hair cutter unit for a dry shaving apparatus, comprising:

a dimensionally stable cutting comb having one cutting teeth row and at least one bearing surface;

an arcuately curved, hardened cutting blade having one cutting teeth row and at least one engagement surface for engaging the at least one bearing surface; and at least one spring element for exerting a pressure to hold the cutting teeth row in engagement with the cutting comb;

wherein a curvature of the hardened cutting blade is partially configured by a forming process such as to ensure conformance and slidable contact of the engagement surface of the cutting blade with the bearing surface of the cutting comb by the partial curvatures as well as their restoring forces under the action of the pressure of the spring element.

2. A long-hair cutter unit for a dry shaving apparatus, comprising:

a dimensionally stable cutting comb having one cutting teeth row and at least one bearing surface;

an arcuately curved, hardened cutting blade having one cutting teeth row and at least one engagement surface for engaging the at least one bearing surface; and at least one spring element for exerting a pressure to hold the cutting teeth row in engagement with the cutting comb;

wherein a curvature of the hardened cutting blade is defined by several bending points, and that conformance and slidable contact of the engagement surface of the cutting blade with the bearing surface of the cutting comb are ensured by said bending points as well as the elasticity of the curved cutting blade under the action of the pressure of the spring element.

3. The long-hair cutter unit according to claim 1 wherein the curvature of the engagement surface of the cutting blade is defined by a sequence of arch elements of similar and dissimilar curvature, with junctions connecting said arch elements being provided as bending points of the cutting blade for adapting the engagement surface of the cutting blade to conform with the bearing surface of the cutting comb under the action of the pressure of the spring element.

4. The long-hair cutter unit according to claim 1, wherein the curvature of the engagement surface of the cutting blade is defined by a sequence of arch elements of identical curvature, with junctions connecting said arch elements being provided as bending points of the cutting blade for adapting the engagement surface of the cutting blade to conform with the bearing surface of the cutting comb under the action of the pressure of the spring element.

5. The long-hair cutter unit according to claim 1, wherein a longitudinal dimension of the cutting blade is divided into arch elements by at least two bending points.

6. The long-hair cutter unit according to claim 1, wherein provision is made for at least two rows of bending points to be arranged parallel to a longitudinal dimension of the cutting blade.

7. The long-hair cutter unit according to claim 1, wherein a wide dimension of the cutting blade is divided into arch elements by at least one bending point.

8. The long-hair cutter unit according to claim 2, wherein each of the bending points is formed by a continuous gradual adaptation of an arcuate curvature of an arch element to conform with an arcuate curvature of an adjoining arch element.

9. The long-hair cutter unit according to claim 1, wherein a longitudinal dimension of the cutting blade is divided into three arch elements by two bending points.

10. The long-hair cutter unit according to claim 9, wherein curvatures of two of the three arch elements are of identical shape, and a curvature of the third arch element is of a shape different from said curvatures of the two arch elements.

11. The long-hair cutter unit according to claim 1, wherein provision is made for at least two spring elements such that the relative distance of one spring element to one end of the cutting blade is equal to the relative distance of the other spring element to the other end.

12. The long-hair cutter unit according to claim 11, wherein the relative distance of the spring elements is essentially equal to the relative distance of one spring element to one end of the cutting blade.

13. The long-hair cutter unit according to claim 2, the direction of the pressure exertable by the spring element is directed essentially onto one of the bending points.

14. The long-hair cutter unit according to claim 2, wherein the hardened cutting blade with bending points has an elasticity or restoring force that counteracts a permanent deformation of a curvature of the cutting blade under the action of the pressure of the spring element.

15. The long-hair cutter unit according to claim 3, wherein an arcuate form of the arch elements and the bending points of the arch elements of the cutting blade are manufacturable by embossing using an embossing die and an embossing pad.

16. The long-hair cutter unit according to claim 3, wherein an arcuate form of the arch elements and the bending points of the arch elements of the cutting blade are manufacturable by varying the compressive stress of a rolling skin of the hardened cutting blade.

17. The long-hair cutter unit according to claim 16, wherein the compressive stress of the rolling skin of the hardened cutting blade is obtainable by exposure to a laser beam.

18. The long-hair cutter unit according to claim 2, wherein a curvature of the engagement surface of the cutting blade is defined by a sequence of arch elements of similar and dissimilar curvature, with junctions connecting said arch elements being provided as bending points of the cutting blade for adapting the engagement surface of the cutting blade to conform with the bearing surface of the cutting comb under the action of the pressure of the spring element.

19. The long-hair cutter unit according to claim 2, wherein a curvature of the engagement surface of the cutting blade is defined by a sequence of arch elements of identical curvature, with junctions connecting said arch elements being provided as bending points of the cutting blade for adapting the engagement surface of the cutting blade to conform with the bearing surface of the cutting comb under the action of the pressure of the spring element.

* * * * *